United States Patent [19]

Wicklund

[11] 4,201,304

[45] May 6, 1980

[54] AUXILIARY TOWEL HOLDER

[76] Inventor: June I. Wicklund, Rte. 1, Box 220, Grantsburg, Wis. 54840

[21] Appl. No.: 882,448

[22] Filed: Mar. 1, 1978

[51] Int. Cl.[2] ..... A47F 5/08

[52] U.S. Cl. ..... 211/87; 211/123; 248/214

[58] Field of Search ..... 211/119, 123, 86, 87, 211/90, 94, 105.1, 99, 100; 248/214, 212, 213, 222.1; 108/29; D6/99, 100, 101-103

[56] References Cited

U.S. PATENT DOCUMENTS

| | | | |
|---|---|---|---|
| 2,589,737 | 3/1952 | Scott-Dalgleish | 211/119 |
| 2,612,273 | 9/1952 | Smith | 211/123 X |
| 3,096,731 | 7/1963 | Lehman | 108/29 |

FOREIGN PATENT DOCUMENTS

| | | | |
|---|---|---|---|
| 544794 | 2/1956 | Belgium | 211/87 |
| 673789 | 1/1930 | France | 211/99 |
| 764481 | 5/1934 | France | 211/87 |
| 495382 | 11/1938 | United Kingdom | 248/222.1 |

*Primary Examiner*—William H. Schultz
*Attorney, Agent, or Firm*—Laurence R. Brown

[57] ABSTRACT

This invention pertains to a device to be fastened to an existing towel bar, which will serve to support additional towels, wash cloths or the like, without substantially detracting from the utilitarian purposes of the existing towel bar. The device may also be used as a wall-mounted installation independently of other devices.

3 Claims, 6 Drawing Figures

AUXILIARY TOWEL HOLDER

BACKGROUND OF THE INVENTION

In household bathrooms and kitchens there is usually provided one or more towel bars for the purpose of supporting towels or the like, of various descriptions. Bath towels, face towels, hand towels as well as wash cloths are supported on these bars to be available when needed. The sizes of these bars are usually such as to provide adequate support for one or two towels. This is inadequate where there are several members in the household or when visitors or guests are being entertained. The inadequacy is further demonstrated when a wash cloth, or the like, is wet and must be supported in a manner to be permitted to dry without contacting other towels or the like.

DESCRIPTION OF THE PRIOR ART

Numerous attempts at coping with this problem have been made but each is, in some way, deficient or falls short of the solution herein set forth. For example, U.S. Pat. No. 2,612,273 issued Sept. 30, 1952 discloses a supplementary fixture support. This involves frictional contact with an existing towel bar, which may readily yield and collapse. U.S. Pat. No. 3,076,556 issued Feb. 5, 1963 discloses a complicated mechanism which is not firmly connected to the towel bar and which extends a substantial distance into the room. U.S. Pat. Nos. 2,705,568 issued Apr. 5, 1955; 2,473,771 issued June 21, 1949; 2,304,285 issued Dec. 8, 1942; 1,956,340 issued Apr. 24, 1934; 2,315,566 issued Apr. 6, 1943; 3,305,101 issued Feb. 21, 1967; and Design Pat. No. 190,552 issued June 13, 1961 are further examples of supporting racks.

An object of this invention is the provision of a towel rack or holder to be attached to an existing towel bar to increase the towel supporting facility thereof without impairing the use of the existing towel bar.

A further object of this invention is a towel holder of unique design which, when attached to an existing towel bar, extends substantially verticaly therefrom to thereby increase the supporting ability thereof without substantially encroaching upon the area spaced from the wall upon which the existing towel bar is mounted.

A further object of this invention is the provision of a towel rack which may be connected to an existing towel bar and which extends substantially vertically upwardly and downwardly from the towel bar whereby to provide additional supporting area.

A surther object of this invention is the provision of a towel rack of unique design and utilitarian configuration which may be independently mounted upon a supporting wall.

BRIEF DESCRIPTION OF THE DRAWINGS

Other objects and features will be readily ascertained from the specification when taken in conjunction with the accompanying drawings, wherein:

FIG. 2 is a front view illustrating the auxiliary supporting arms for supporting a wash cloth or the like;

DETAILED DESCRIPTION OF THE INVENTION

Figure 2:
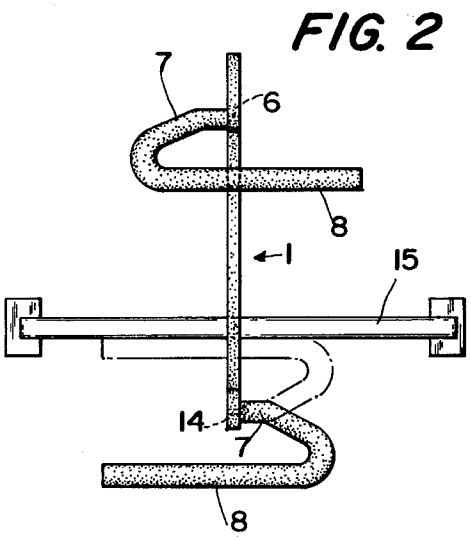
Figure 3:
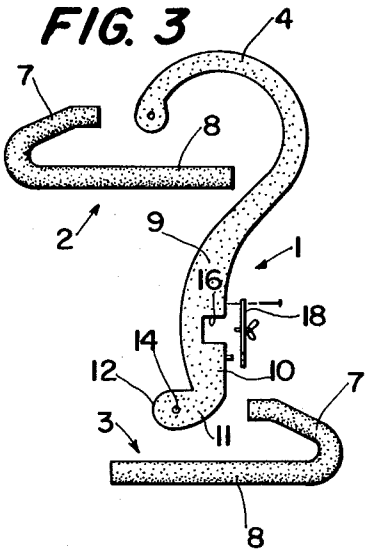
FIG. 3 is an exploded view of the auxiliary towel holder.

The auxiliary towel holder comprises a main vertical support 1 and generally horizontally disposed arms 2, 3 extending therefrom. The vertical support is provided at its upper end with a substantially U-shaped portion 4 whose extremity 5 provides a pivotal mounting 6 for the horizontally disposed arm 2. The arm 2 is substantially J-shaped, the shorter end 7 of which is connected at the pivot 6 to the extremity 5. The longer end 8 of the J-shaped member extends perpendicular to the upwardly extending portion 9 of the vertical support 1, as is shown in FIG. 2. The main vertical support 1 further comprises a downwardly extending portion 10 having a curved section 11 whose extremity 12 provides a pivotal mounting 14 for the horizontally disposed arm 3. The arm 3 is substantially identical to the arm 2. It will be noted, however, that as illustrated in FIG. 2 to the arm 2 is pivoted at the left of the main vertical support 1, while the arm 3 is pivoted at the right of the main vertical support. This results in an attractive balanced auxiliary holder wherein the portions 8 extend substantially horizontally and parallel to each other.

The auxiliary towel holder is completed by means for fastening it to the towel bar 15. A recess or notch 16 in the vertical support is adapted to embrace the towel bar 15 on three sides thereof. Latch means 17 comprising a plate 18 pivoted at 19 and engaging a hook 20 covers the fourth side. A thumb screw 21 is tightened down upon the towel bar 15 to firmly attach the auxiliary towel holder thereto.

The auxiliary towel holder may be readily fastened to the towel bar by merely disposing the recess or notch 16 over the towel bar 15, pivoting the plate 18 about the axis 19 to engage the hook 20. After rotating the thumb screw 21 to engage the towel bar 15, the auxiliary towel holder is fixed and ready for use. Reverse rotation of the screw 21 will obviously release the towel holder.

It will be noted that the curved section 11 extends a distance away from the vertical support less than that of the U-shaped support 4. With this arrangement a wet wash cloth mounted upon the lower portion 8 will not be in contact with one hanging from the upper member 8, while both will be spaced from towels suspended from the towel bar 15. One or more auxiliary towel holders may be mounted on the original towel bar while maintaining substantially all of the effective use of the original towel bar. While members 8 have been illustrated as round in cross section, it is obvious that the entire device may be made in any suitable configuration and of any material such as wood, plastic or metal. Further, while members 8 have been illustrated as pivoted to the vertical support, with the concomitant advantages of adjustability, it is manifest that the vertical support 1 and the arms 2 and 3 may be made of one unitary structure.

Figure 6:
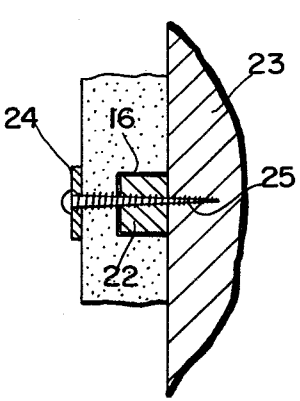
FIG. 6 is a side view of the modification of FIG. 5.
Figure 5:
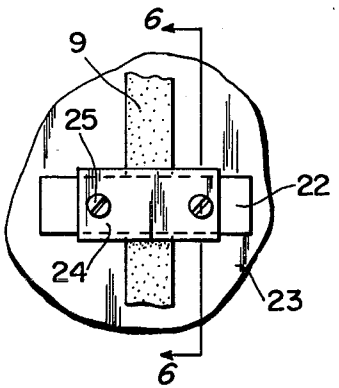
FIG. 5 is a front view of a modified mounting means.
Figure 4:
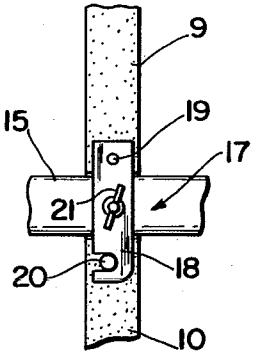
FIG. 4 is a view of the back side showing the latch means and tightening element.
Figure 1:
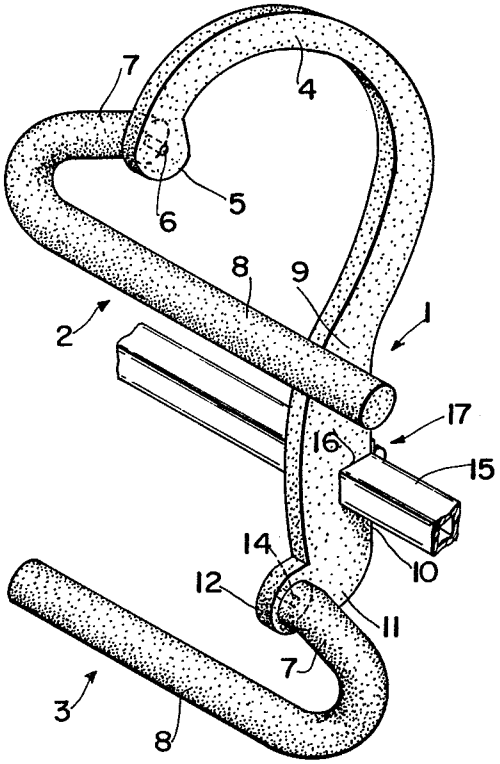
FIG. 1 is a perspective view of the device mounted upon a towel bar.

FIGS. 5 and 6 illustrate an alternative arrangement where the auxiliary towel holder may be fastened to the wall as a permanent fixture. A bar 22 is fastened to the wall 23 and the notch or recess 16 of the vertical support is placed in overlapping relation thereto as is shown in FIG. 6. Plate 24 overlies the vertical support and is fastened to the bar 22 by members 25.

While several embodiments of this device have been shown and described, it is clear that other modifications may be made within the scope of the claims appended hereto.

What is claimed is:

1. A towel holder comprising a vertical main support having an upper and a lower end; said upper and lower ends each having parallel horizontally disposed arms thereon; each of said arms being positioned in a vertical plane different from the other and each being further disposed in a vertical plane different from that of the main support; said horizontally disposed arms being rebent upon themselves to a J-shaped configuration and pivotally supported proximal the J-shaped portion with the arms being adjustingly positionable toward and away from each other and the main support and extending laterally to each side of said main support.

2. The device of claim 1 wherein said main support is provided with latch means for releasably connecting said towel holder with other towel holding means carried by an external support so that said towel holder is distal from said external support.

3. The device of claim 2 wherein said latch means comprises a notch in said main support, said movable plate is pivotably attached to said main support and a portion of the plate is releasably securable to said main support.

* * * * *